US007225657B2

(12) United States Patent
Slawinski

(10) Patent No.: US 7,225,657 B2
(45) Date of Patent: Jun. 5, 2007

(54) ELIMINATION OF ROLLING MILL CHATTER

(75) Inventor: James Stanley Slawinski, Ogden Dunes, IN (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 11/119,807

(22) Filed: May 3, 2005

(65) Prior Publication Data

US 2005/0247095 A1 Nov. 10, 2005

Related U.S. Application Data

(60) Provisional application No. 60/567,808, filed on May 5, 2004.

(51) Int. Cl.
*B21B 31/00* (2006.01)

(52) U.S. Cl. ..... 72/245; 72/237

(58) Field of Classification Search ..... 72/237, 72/245, 246, 242.2, 242.4
See application file for complete search history.

(56) References Cited

U.S. PATENT DOCUMENTS 3,302,435 A * 2/1967 Lyle et al. ..... 72/245
4,402,207 A 9/1983 Buder
6,354,128 B1 3/2002 Donini et al.
6,748,782 B1 * 6/2004 Nakajima et al. ..... 72/241.8
6,763,694 B1 7/2004 Boulton et al.
2002/0023473 A1 2/2002 Harako et al.
2003/0019271 A1 1/2003 Yamamoto et al.
2003/0024292 A1 2/2003 Yamamoto et al.
2003/0024293 A1 2/2003 Yamamoto et al.
2004/0040359 A1 3/2004 Yamamoto et al.

FOREIGN PATENT DOCUMENTS

DE 4434797 A1 * 4/1996

* cited by examiner

*Primary Examiner*—Dmitry Suhol
(74) *Attorney, Agent, or Firm*—Edward H. Jones

(57) ABSTRACT

A method for eliminating the vibrational chatter in a rolling mill stand, whereby existing roll chocks are machined to allow commercially available thrusting means, including hydraulic cylinders and the accompanying fittings and tubing, to be installed directly into the chocks so that when activated the thrusting means thrust horizontally outward to take up any gapping or play occurring between the chock face and the mill housing during normal mill operations, thus effectively eliminating chatter.

12 Claims, 3 Drawing Sheets

ELIMINATION OF ROLLING MILL CHATTER

RELATED APPLICATION

This application incorporates in its entirety and claims the full benefit of provisional application 60/567,808 of the same title, filed May 5, 2004.

FIELD OF THE INVENTION

This invention relates to a method and device for eliminating the chatter that occurs in rolling mill stands. Specifically, the invention involves installation and use of hydraulic cylinders within the roll chocks of a rolling mill stand to eliminate the gapping that occurs between the chocks and the mill stand housing during rolling operations, thus eliminating vibrational chatter.

BACKGROUND OF THE INVENTION

Cold reduction mills are used throughout the steel industry for taking a coiled strip of hot-rolled, pickled steel and reducing the strip to the final gauge required by the customer. In a typical cold reduction tandem mill, the strip passes through a number of stands whereby each stand may reduce the strip by 20% to 25% in thickness. In a four-high tandem mill, each individual stand typically consists of a housing having two walls, a top, and a base that form an open window. Within the window is a vertical assembly of four rolls under pressure made up of two work rolls through which the strip passes and two backup rolls which help support the work rolls. The backup rolls and the work rolls are, in turn, supported in the individual stand by bearing assemblies known as chocks. In a four-high assembly, there are a total of eight chocks—four work roll chocks and four backup roll chocks—such that each chock supports each end of the four rolls. Each chock has two surfaces that face each of the two walls of the mill stand housing. The inner surface of the two walls of the mill stand housing and the chock surfaces facing those walls all possess metal liners to extend the life of each of the respective surfaces.

The strip to be rolled is fed from the entry side of the first mill stand, passes between the top and bottom work rolls, and then emerges from the exit side of the mill stand. In the same manner, the strip then proceeds through each successive stand in the tandem. Enough load is transferred to the strip via the rolls by means of a screw down or other type of pressure device situated atop each stand so that the strip emerges from the last stand in the sequence at the desired thickness.

Most cold reduction tandem mills, especially five and six stand cold reduction mills, operate at a high rate of speed, usually in the range of 4,000 to 6,000 feet per minute. At times, when operating at high speeds the cold reduction tandem mill may experience a condition known as third octave mode chatter, also referred to as audible and/or vibrational chatter. This type of chatter takes place when the two smaller work rolls are allowed to vary in separation or "bounce" in a short vertical direction at high movement frequency. The separation results when forces inherent to the rolling operation interact with the resonant characteristics of the mill housing. Vibrational chatter particularly affects high-speed, flat metal strip rolling mills.

There have been many theories put forth over the years regarding factors that contribute to chatter. These theories have focused on factors such as work roll and backup roll bearing wear, lubrication deficiencies, faulty work roll finish, strip interstand tensions, and directional forces exerted by the rolls, to name a few. Regardless of the contributing cause, in order for mill chatter to occur, there has to be a high frequency change in the work roll gap of the particular mill stand. This can only take place if there is a slight vertical movement between the two opposing work rolls. This problem is most prevalent on lighter gauge strip, and usually, if not always, on the later stands of a tandem mill.

Any horizontal movement of a back-up roll chock in relation to its mill stand housing liner, even if not excessive, can result in a slight vertical movement of the work rolls, resulting in vibrational-type chatter. In years past, experienced cold reduction mill operators tried to avoid chatter by driving metal shims between the backup roll chock liner and the mill window. This resulted in a crude and temporary, but sometimes effective, tool for reducing chatter.

Typical cold reduction mills are designed to have an initial clearance between a backup roll chock and its mill stand window of approximately 0.020 to 0.030 inches per side, or 0.040 to 0.060 inches total. The clearance is needed to facilitate changing and stacking of rolls and movement of spindles, couplings, and gears during operation. However, this intentionally designed initial gap quickly deteriorates over time because of vibrational forces, resulting in chatter and its accompanying problems. By eliminating the gap between the backup roll chock and the mill stand housing, the backup rolls are prevented from moving at a high frequency in the horizontal direction which, in turn, prevents the work rolls in the same stand from oscillating at a high frequency in the vertical direction, thus eliminating undesirable third octave mode chatter.

Chatter has long been a major quality and productivity issue for high-speed, cold reduction mills. Vibrational chatter can result in excessive gauge variation in the metal strip being produced. Chatter can cause undesirable, visible, ripple-like "chatter marks" along the strip, which can necessitate its rejection. In addition, if chatter is severe enough, strip breaks and equipment damage can occur, resulting in mill downtime and loss of productivity. To compensate for chatter, a mill usually has to reduce operating speed. It is not unusual for a high-speed, cold reduction mill to reduce its speed by 20 to 30% to avoid chatter. The steel coil that is produced when the mill is experiencing chatter often has to have the chatter-affected portion removed and downgraded to scrap, which necessitates additional reprocessing of the coil. This reprocessing and downgrading can cause the processor to incur substantial economic loss. Consequently, reduction or elimination of vibrational-type mill chatter results in higher mill speeds, greater productivity, fewer strip breaks, less reprocessing of defective product, less diverted product, less equipment damage, and most importantly for the processor, greater profitability.

There is known in the art numerous devices for adjustment of the gapping that develops between the chocks and the housing of a rolling mill stand. These devices typically employ some type of hydraulically activated means of taking up or compensating for the gap, usually in the form of pistons/cylinders or inflatable metal bladders which, when activated, either opposingly thrust against or expand outwardly into the chock/housing gap, thus reducing the opportunity for "play" or gapping and the resulting vibrational chatter.

Such hydraulically activated piston-like devices are described in U.S. Pat. Nos. 6,763,694 and 6,354,128, and U.S. patent application Ser. Nos. 10/433,758; 10/192,700;

10/192,641, 10/192,638, and 09/791,753. U.S. Pat. No. 4,402,207 describes a hydraulically activated bladder-type device.

With these devices, the adjustment means are situated either within the mill stand housing itself or incorporated into a movable structure separate from the chock and housing. When situating these devices in the mill stand housing, their installation and maintenance requires that the particular operating line completely shut down for extended periods, resulting in a loss in productivity. In addition, the machining and other modifications needed to install these devices within the mill housing could very likely compromise the housing's structural integrity. Further, installation of gap adjustment devices within a mill housing is limited to the particular stand involved, so that the specific device cannot easily be transferred to other stands or even other mills without expensive modification of the stand housing slated to receive the device. Similarly, location of hydraulically activated devices in separate support elements or movable frames requires that the chocks and housing be specially designed and fabricated to accommodate the additional structural element which itself may require extensive fabrication. Lastly, German patent DE 44 34 797 discloses a system of hydraulic pressure push rods inserted directly into roll chocks to correct the lie of the chocks. However, none of the above patents teach a practical and cost effective means of easily retrofitting existing rolling mill chocks to accommodate a commercially available means of providing horizontal thrust to take up the gapping between a chock and its mill housing to successfully eliminate vibrational chatter.

Because of the high cost involved, it would be rare for a rolling mill to purchase all new backup chocks solely for the purpose of fabricating and installing any of the devices and methods taught in the prior art. However, the present invention allows a mill to cost effectively retrofit existing backup chocks with commercially available materials to effectively eliminate vibrational chatter.

SUMMARY OF THE INVENTION

The present invention involves the installation of commercially available hydraulic cylinders within backup roll chocks of a rolling mill stand and the use of such cylinders to provide sufficient horizontal thrust from the cylinder plungers to eliminate any gapping between the cylinder-containing chock and the inner wall of its mill stand housing, thus preventing vibrational chatter.

One or more pairs backup roll chocks are machined in such a way that a plurality of hydraulic cylinders can be inserted into openings specifically bored to receive the cylinders. The backup roll chocks are also machined to create channels to receive the metal fittings and tubing needed to interconnect all the cylinders of an individual backup roll chock and also to tie the cylinders into the mill's existing hydraulic system. The particular patterns of machining depend on the desired arrangement of the cylinders and also the presence of any exiting structures of the chock face surface that need to be avoided. The machining is such that the cylinders, fittings, and tubing are all seated below the vertical face of the chock surface. Thus, the components of the invention avoid contact with the liner that is fitted against the chock face. In a similar fashion, the chock liner is also bored completely through according to the same pattern as the cylinder borings so that the plungers of the cylinders installed in the chocks can extend though the liner borings when the cylinders are activated.

By installing the hydraulic cylinders in backup roll chocks rather than in the mill stand housing or separate support elements as taught by prior art, all machining can be carried out during normal scheduled maintenance when rolls and their chocks are removed for routine reconditioning and immediately substituted with replacement rolls and chocks. The machining required can be performed by any large machine shop. Thus, a chock fitted with the present invention can be reinstalled as part of a normal maintenance rotation schedule. Since the mill stand housing is not affected by installation of the present invention, and since chocks can be removed and replaced without significantly interrupting the mill's operation, no production time is lost.

Similarly, all maintenance and repairs can easily be carried out without shutting down the entire tandem mill. The cylinders, fittings, and tubing are all standard, commercially available items and can be installed in any or all stands, and in some cases, can be installed in an entirely different mill as long as it possesses similar backup roll chocks. The fittings and tubing are preferably made of a material that resists corrosion, such as stainless steel. Installation of the present invention into a backup roll chock has been found to be less expensive than if it had to be installed in a mill stand housing or separate support element as taught by the prior art. Also, the structural integrity of the mill stand housing is not compromised by installation of the present invention into a backup roll chock, and all components of the system are contained under the chock liner so the system is protected from damage. Another advantage of the present invention is that it will automatically compensate for liner wear. As the gap between the mill stand housing liner and the backup roll chock liner increases because of normal wear, the invention, when activated, will take up the gap resulting in longer liner life and less frequent liner replacement.

Application of the present invention in an operating five-stand, four-high, cold reduction tandem mill has resulted in the elimination of chatter and a corresponding increase in productivity. Specifically, installation of commercially available hydraulic cylinders, each with a rated capacity of 50 tons, into backup roll chocks has been found to be sufficient to eliminate the backup roll chock to mill stand housing gapping and the resulting vibrational chatter. The applicant has thus designed, tested, and embodied his invention to successfully overcome the costly problem of vibrational chatter that to this day plagues rolling mill operators.

BRIEF DESCRIPTION OF DRAWINGS

The present invention will become more fully understood from the detailed description of the preferred embodiment and the accompanying drawings which are given by way of illustration only, and are thus not limitative of the present invention.

DESCRIPTION OF THE PREFERRED EMBODIMENT

The preferred embodiment of the present invention is described with reference to the accompanying drawings, which in no way limit the invention.

Figure 1:
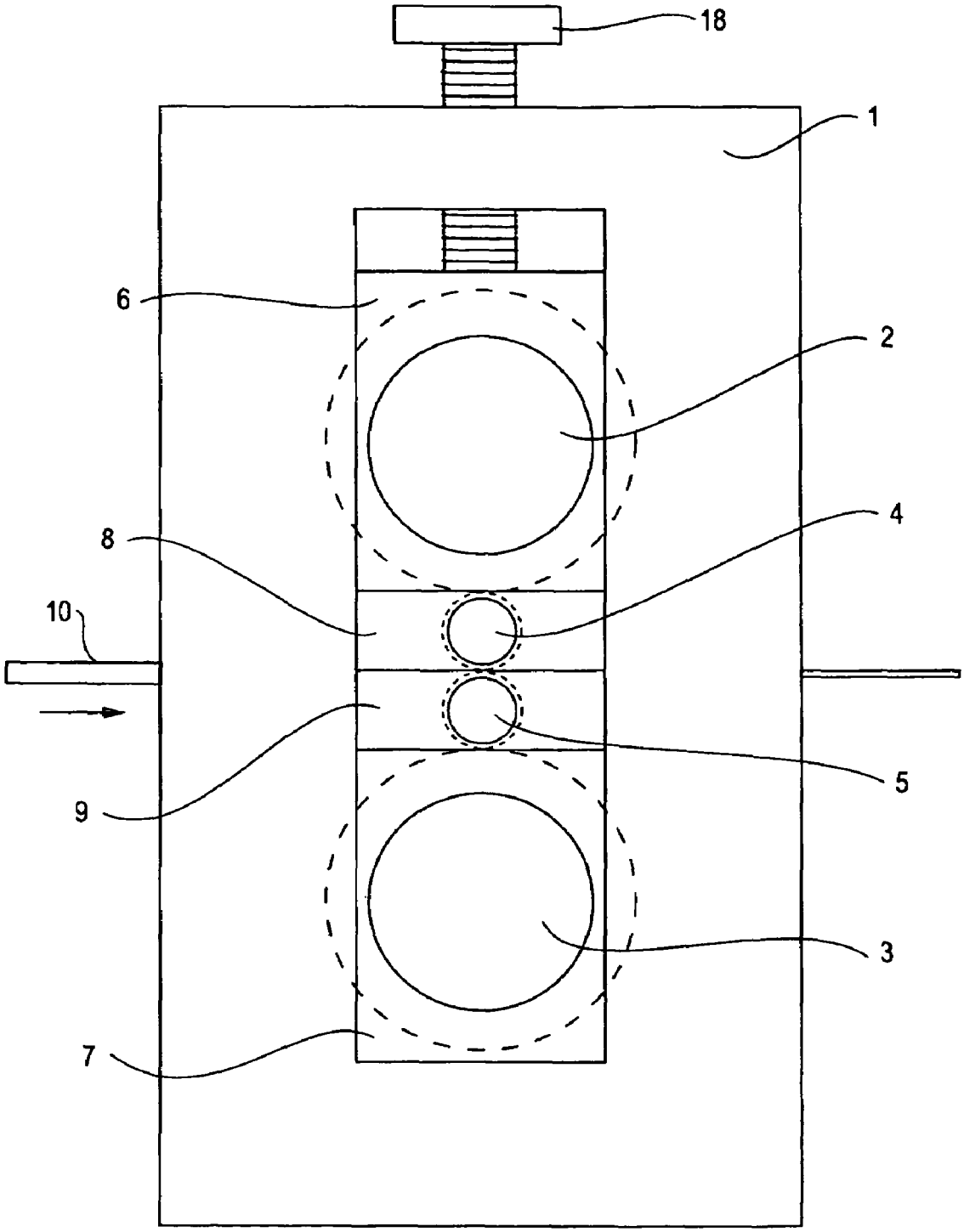
FIG. 1 is a schematic side view of the housing of a four-high rolling mill stand.

A typical four-high rolling mill stand is shown in FIG. 1. The stand housing 1 consists of two walls, a top and a base, which form a window in which sits an upper backup roll 2 supported by an upper backup roll chock 6, a lower backup roll 3 supported by a lower backup roll chock 7, an upper work roll 4 supported by an upper work roll chock 8, and a lower work roll 5 supported by a lower work roll chock 9, and a screw down device 18 or other pressure means for applying a desired load to the rolls. In a four-high tandem mill, the metal strip to be worked 10 enters the housing from the entry side and passes through the two work rolls 4 and 5, with the two backup rolls 2 and 3 providing additional support. Only the ends of the rolls are shown in FIG. 1, with the actual rolling surfaces hidden from view and depicted by broken lines. The four-high assembly has a total of eight chocks that support each end of the four cylindrical rolls. Only four of the chocks are shown in FIG. 1.

Figure 2:
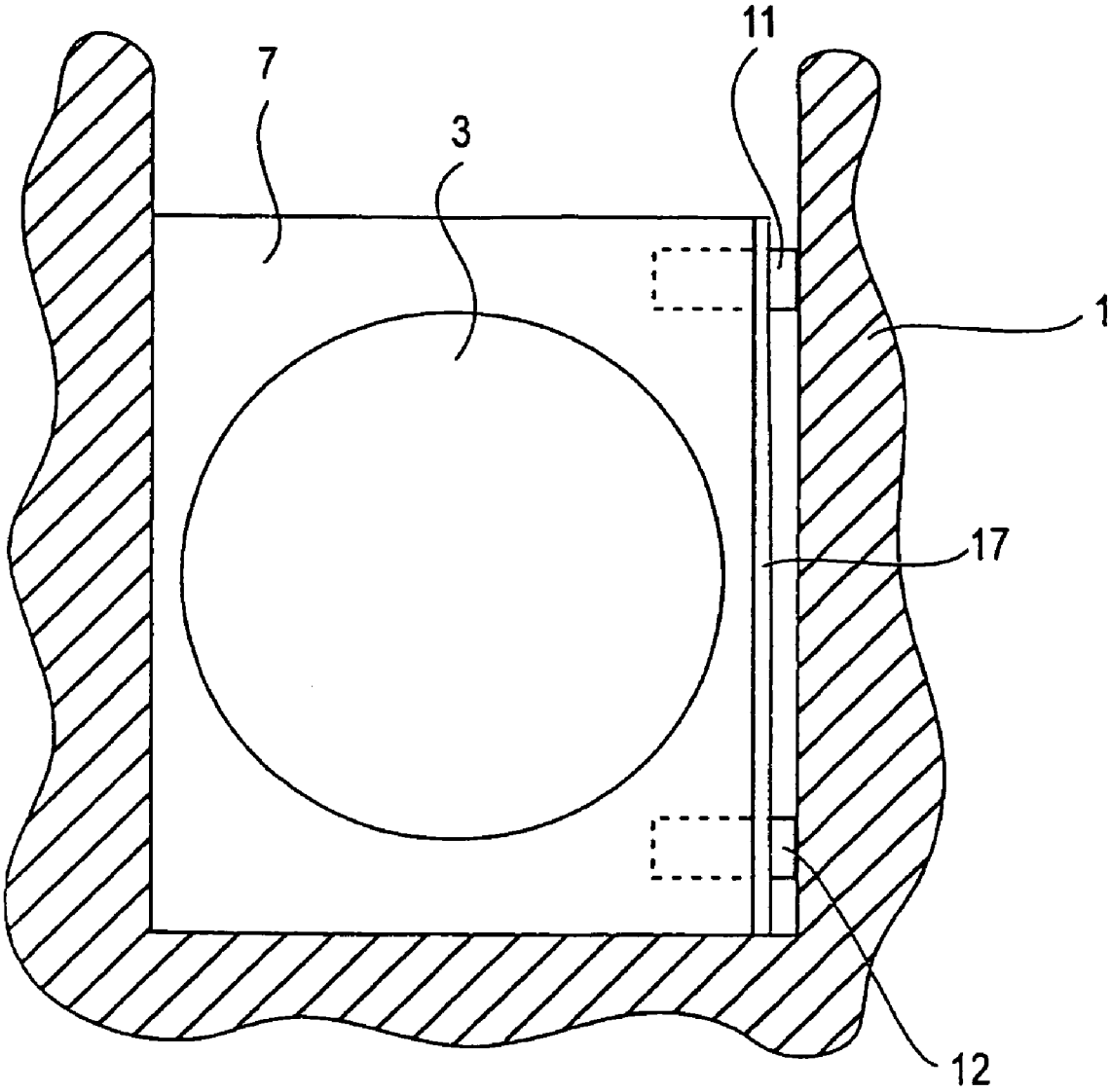
FIG. 2 is a detailed side view of the lower portion of the housing stand of a four-high rolling mill, showing one end of a lower backup roll, its corresponding lower backup roll chock, and two hydraulic cylinders of the present invention.
Figure 4:
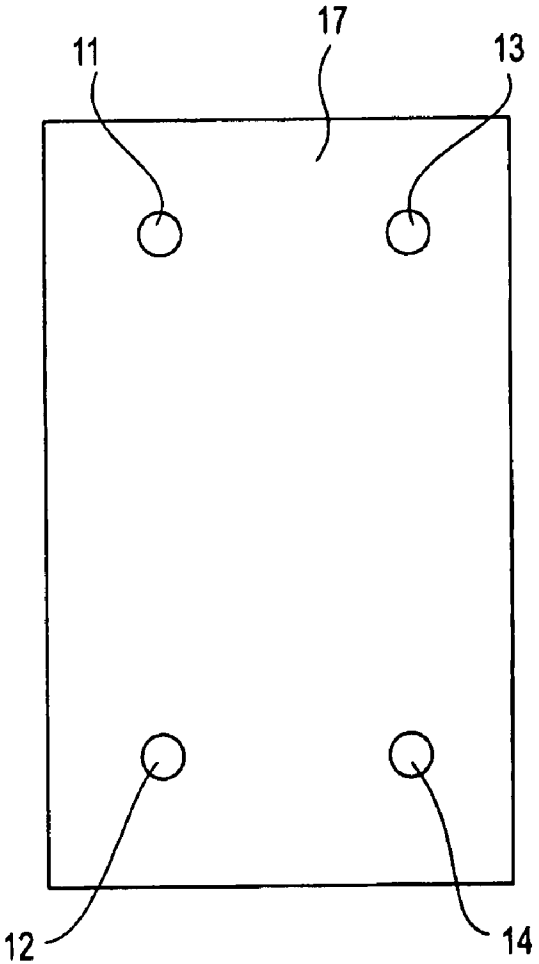
FIG. 4 is a frontal view of the liner for a backup roll chock showing the pattern of borings configured to align with the borings of the corresponding backup roll chock.
Figure 3:
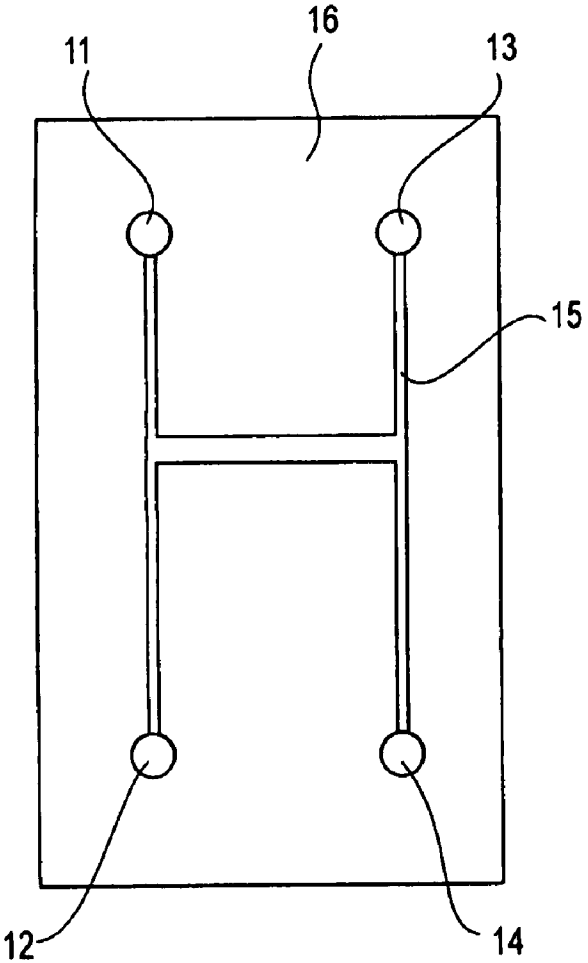
FIG. 3 is a frontal view of the face of a backup roll chock showing a machining pattern of borings to accommodate hydraulic cylinders of the present invention and also a machining pattern of channels to accommodate accompanying fittings and connecting tubing.

With the preferred embodiment of the present invention, the lower pair of backup chocks of one of the later mill stands are machined so that a set of four hydraulic cylinders can be installed in the vertical exit side of each of the pair of chocks. Only two cylinders 11 and 12 of the present invention are shown in FIG. 2. The two cylinders are shown in one of the pair of lower backup chocks 7. When activated, as is shown in FIG. 2, the hydraulic cylinders thrust out their plungers horizontally from the pair of lower backup roll chocks, through the machined openings of each respective backup roll chock liner 17, closing the gap between each backup roll chock 7 and the inner wall of the mill stand housing 1, thus eliminating vibrational chatter. The Enterpac Flat-Jac® RSM-500 single-acting hydraulic cylinder has been found to work exceptionally well in the present invention. The bottom backup chocks are machined such that the hydraulic cylinders can all be seated below the vertical surface of the chock face. Care is taken to machine the lower backup roll chocks so as to not interfere with the operation of each lower backup roll 3. FIG. 3 shows a typical machining pattern for a lower backup roll chock vertical face 16. In the preferred embodiment, holes are bored to accommodate four cylinders 11, 12, 13, and 14 in each backup roll chock. Spacing of cylinders is such that the force required to eliminate gapping in the mill housing window is equally distributed. Channels 15 are also machined to accommodate the metal fittings and tubing needed to hydraulically interconnect all of the cylinders situated in the lower backup roll chocks. As with the hydraulic cylinders, the bottom backup chocks are machined such that the fittings and tubing can all be seated below the vertical surface of the chock face. The actual machining pattern may vary depending on the configuration of the face of the particular backup roll chocks and the presence of any surface structures that need be avoided. An opening for a side fitting (not shown) leading out from the side of each lower backup roll chock can also be bored so the that present invention can be connected to the mill's existing hydraulic system. Upon installation of all cylinders, fittings, and tubing, each lower backup roll chock liner 17 is fitted against the face of its lower backup roll chock 16 so that the holes of the chocks and their corresponding liners are aligned. Accordingly, the plungers of the cylinders 11, 12,13, and 14, when hydraulically activated, can thrust out from the face of the backup roll chock 16 through the corresponding holes bored through the chock liner 17, so that the plungers can bear against the inner wall of the mill stand housing, effectively taking up the chock/housing gap and eliminating the potential for chatter.

While the present invention has been described in the foregoing manner, it is to be understood that it is not limited thereby, but may be varied in other ways. The preferred embodiment above is not intended to preclude or limit variations in the number, size, arrangement, or location of hydraulic cylinders or other thrusting means that can be installed in one or more pairs of chocks of one or more rolling mill stands to effectively eliminate chatter. The thrusting means need not be limited to hydraulically activated cylinders. Other thrusting means may be found to be preferable, depending on the particular setup of the mill. Such variations are not intended to be regarded as a departure from the spirit and scope of the invention, and all such modifications as would be obvious to one skilled in the art are intended to be included within the scope of the information contained herein.

What is claimed is:

1. A method of eliminating vibrational chatter in a rolling mill stand, the rolling mill stand comprising a housing having an entry side wall and an exit side wall each attached to a top and a base, all of which form an open housing window, an upper work roll rotatably supported within the housing window at each end of the upper work roll by a pair of upper work roll chocks, a lower work roll rotatably supported within the housing window at each end of the lower work roll by a pair of lower work roll chocks, an upper backup roll rotatably supported within the housing window at each end of the upper backup roll by a pair of upper backup roll chocks, a lower backup roll rotatably supported within the housing window at each end of the lower backup roll by a pair of lower backup roll chocks, chock liners fitted against each vertical chock surface that faces either the entry side wall or the exit side wall of the housing, a pressure means situated atop the housing to apply a desired load to the the upper and lower work rolls and upper and lower backup rolls, a plurality of thrusting means each seated below vertical surfaces of at least one pair of backup roll chocks to provide outward horizontal thrust against the adjacent housing side wall, and an activating means to activate all of the thrusting means, the method comprising the steps of:

machining borings and channels in said pair of backup roll mill chocks sufficient to seat the thrusting means and any needed fixtures and tubing below the vertical surfaces of the chocks facing a housing side wall, each of said channels forming a longitudinal opening in a vertical surface of each chock in said pair along the length of said channel, said channel extending inwardly from said opening below the vertical surface of each said chock, machining the liner of each correspondingly machined chock with openings sufficiently aligned with the borings of the respective chock to allow the thrusting means to freely thrust horizontally outward against the housing side wall, attaching each machined liner to its respective chock in an alignment that allows the thrusting means to freely thrust horizontally outward against the housing side wall, and interconnecting the thrusting means of each machined chock to an activating means so that when activated each thrusting means thrusts outward against one side of the housing to take up any gapping that may exist between the machined chocks and the housing side wall.

2. The method of claim 1, wherein the thrusting means is hydraulically activated.

3. The method of claim 1, wherein the thrusting means is a single-acting hydraulic cylinder.

4. The method of claim 1, wherein the activating means is a hydraulic pressure system.

5. The method of claim 1 wherein said pair of backup roll chocks are for the bottom backup roll.

6. The method of claim 1 further comprising machining borings and channels for four thrusting means and any necessary fixtures and tubing in each backup roll chock in said pair.

7. A rolling mill stand comprising:

a housing having an entry side wall and an exit side wall each attached to a top and a base, all of which form a open housing window, an upper work roll rotatably supported within the housing window at each end of the upper work roll by a pair of upper work roll chocks, a lower work roll rotatably supported within the housing window at each end of the lower work roll by a pair of lower work roll chocks, an upper backup roll rotatably supported within the housing window at each end of the upper backup roll by a pair of upper backup roll chocks, a lower backup roll rotatably supported within the housing window at each end of the lower backup roll by a pair of lower backup roll chocks, chock liners fitted against each vertical chock surface that faces either the entry side wall or the exit side wall of the housing, a pressure mean situated atop the housing to apply a desired load to the upper and lower work rolls and the upper and lower backup rolls, a plurality of thrusting means each seated below the vertical surfaces of at least one pair of backup roll chocks to provide outward horizontal thrust against the adjacent housing wall, each backup roll chock in said pair having a plurality of borings and channels sufficient to seat a thrusting means and any needed fixtures and tubing below the vertical surfaces of the chocks facing a housing side wall, each of said channels forming a longitudinal opening in a vertical surface of each said chock along the length of said channel, said channel extending inwardly from said opening below the vertical surface of each said chock, and an activating means to activate all of the thrusting means.

8. The rolling mill stand of claim 7, wherein the thrusting means is hydraulically activated.

9. The rolling mill stand of claim 7, wherein the thrusting means is a single-acting hydraulic cylinder.

10. The rolling mill stand of claim 7, wherein the activating means is a hydraulic pressure system.

11. The rolling mill stand of claim 7 wherein said borings and channels and thrusting means, fixtures and tubing are located in the pair of chocks for the bottom backup roll.

12. The rolling mill stand of claim 7 wherein four thrusting means and necessary fixtures and tubing are located in borings and channels in each backup roll chock in said pair.

* * * * *